US009273919B2

(12) United States Patent
Merlino et al.

(10) Patent No.: US 9,273,919 B2
(45) Date of Patent: Mar. 1, 2016

(54) DRIVE ASSEMBLY OF A FIREARM

(71) Applicant: A. UBERTI S.p.A., Gardone Val Trompia (BS) (IT)

(72) Inventors: Giacomo Merlino, Gardone Val Trompia (IT); Antonio Mazzoleni, Gardone Val Trompia (IT)

(73) Assignee: A. UBERTI S.P.A., Gardone Val Trompia (BS) (IT)

( * ) Notice: Subject to any disclaimer, the term of this patent is extended or adjusted under 35 U.S.C. 154(b) by 0 days.

(21) Appl. No.: 14/566,528

(22) Filed: Dec. 10, 2014

(65) Prior Publication Data

US 2015/0362274 A1 Dec. 17, 2015

(30) Foreign Application Priority Data

Jun. 12, 2014 (IT) ..... BS14A0107

(51) Int. Cl.
*F41A 19/10* (2006.01)
*F41A 19/14* (2006.01)

(52) U.S. Cl.
CPC ..... *F41A 19/10* (2013.01); *F41A 19/14* (2013.01)

(58) Field of Classification Search
CPC ..... F41A 19/10; F41A 19/13; F41A 19/42; F41A 19/00; F41A 19/14; F41A 19/24; F41A 19/25; F41A 19/44
USPC ..... 42/69.01, 69.03, 66
See application file for complete search history.

(56) References Cited

U.S. PATENT DOCUMENTS

| | | | | | |
|---|---|---|---|---|---|
| 808,214 | A | * | 12/1905 | Putnam | 42/69.01 |
| 818,721 | A | * | 4/1906 | Wesson | 42/65 |
| 1,569,856 | A | * | 1/1926 | Emil | 42/7 |
| 3,086,310 | A | * | 4/1963 | Katz | 42/70.08 |
| 3,626,623 | A | * | 12/1971 | Uberti | 2/66 |
| 3,748,771 | A | * | 7/1973 | Piscetta | 42/66 |
| 3,988,848 | A | * | 11/1976 | Chatigny | 42/70.08 |
| 4,040,196 | A | * | 8/1977 | Smith et al. | 42/23 |
| 4,316,340 | A | * | 2/1982 | Kahn | 42/66 |
| 4,316,341 | A | * | 2/1982 | Landry | 42/70.08 |
| 4,391,057 | A | * | 7/1983 | Bornancini | 42/65 |
| 4,449,312 | A | * | 5/1984 | Ruger et al. | 42/66 |
| 4,627,185 | A | * | 12/1986 | Rohm | 42/66 |
| 4,680,884 | A | * | 7/1987 | Smith et al. | 42/66 |
| 5,166,458 | A | * | 11/1992 | Yoo | 42/69.03 |
| 5,335,437 | A | * | 8/1994 | Andersen | 42/70.08 |

(Continued)

FOREIGN PATENT DOCUMENTS

IT 1327534 8/2001

*Primary Examiner* — Bret Hayes
*Assistant Examiner* — Derrick Morgan
(74) *Attorney, Agent, or Firm* — Volpe and Koenig, P.C.

(57) ABSTRACT

A drive assembly of a firearm includes a hammer, a firing pin, a trigger and drive means for driving the firing pin. The hammer includes a main body having at least a first tooth, a first seat engaged by the firing pin and a second seat engaged by the drive means that intercepts the first seat. The firing pin and the drive means are movable in the respective seats between a first rest portion, distal one from another, and a second firing position, respectively, proximal one to another. The trigger includes a first portion that, when the trigger is pivoted, it is movable between the first and second positions, respectively. The trigger includes a second portion configured to engage/disengage the first tooth and a third portion configured to counter the drive means when the first portion of the trigger is in the second position and the first tooth is disengaged.

10 Claims, 6 Drawing Sheets

(56) References Cited

U.S. PATENT DOCUMENTS

| | | | | |
|---|---|---|---|---|
| 5,724,759 | A * | 3/1998 | Kilham | 42/66 |
| 6,336,282 | B1 * | 1/2002 | Buffoli | 42/66 |
| 6,442,880 | B1 * | 9/2002 | Allan | 42/70.08 |
| 6,460,282 | B1 * | 10/2002 | Bustos | 42/66 |
| 7,739,821 | B1 * | 6/2010 | Hamme | 42/8 |
| 8,567,104 | B1 * | 10/2013 | Donnelly | 42/66 |
| 8,720,096 | B2 * | 5/2014 | Siddle | 42/69.01 |
| 2003/0126782 | A1 * | 7/2003 | Baker | 42/66 |
| 2003/0192221 | A1 * | 10/2003 | Merlino | 42/66 |
| 2005/0028420 | A1 * | 2/2005 | Rossi | 42/70.08 |
| 2005/0183313 | A1 * | 8/2005 | Baker | 42/70.08 |
| 2012/0042555 | A1 * | 2/2012 | Alves | 42/69.03 |

* cited by examiner

DRIVE ASSEMBLY OF A FIREARM

FIELD OF THE INVENTION

In its most general aspect the present invention relates to the field of firearms and, in particular, to that of revolvers and breech-loading pistols. Still more particularly, the invention relates to a drive assembly of a firearm of the abovementioned type comprising a so-called passive safety system.

BACKGROUND

As known, the firearms, such as pistols, revolvers, guns and the like, are provided with safety devices, usually called "safeties", intended to prevent an accidental discharge of the firearm.

A bullet can be fired by accident, for example by the firearm falling to the ground, or by an awkward operation of the person handling the firearm which could cause the so-called firearm hammer to undesirably unlatch.

If safeties are activated, particularly in case of revolvers, they prevent the firearm hammer from striking the bullet through the so-called firing pin.

In detail, a revolver provided with a so-called passive safety system typically comprises, in addition to a handle and to the above mentioned hammer and firing pin, also a frame having the hammer pivoted thereto so as to be rotatable at least between a cocked position and a striking position and to which the firing pin is combined to be, in its turn, movable between a striking or firing forward position and a rest or safe backward position, and a user-operated trigger for controlling the hammer to be unlatched and thus rotated and for causing the bullet to be stricken and thus discharged.

Applicant's Italian Patent, IT 1327534, discloses a safety device for a revolver, comprising transmission means extending into the hammer and interposed between the trigger and a movable firing pin, wherein the hammer is provided with a safety tooth apt to interact with a beak-shaped end of the trigger to lock the hammer when it is unlatched.

In particular, the safety device of the aforesaid Patent locks the firing pin in a forward position when the hammer is in a cocked position, and moves the firing pin in a safety backward position when the hammer is unlatched from the cocked position and the trigger beak engages the safety tooth of the hammer.

In practice, in the safety position, even if the hammer is totally in abutment against the firearm frame, the firing pin is not able to act onto the bullet charge.

Although a solution such as the above evaluated one achieves the purpose, it suffers from some drawbacks among which the most important is to be mechanically complex, both structurally and functionally.

In fact, it is quite difficult to assemble and mount the several elements that make up the transmission means, and is also complicated to drive them and make them work on the whole.

SUMMARY OF THE INVENTION

The technical problem underlying the present invention is to provide a drive assembly of a firearm, particularly a revolver, having structural and functional characteristics such as to overcome the drawbacks abovementioned with reference to the known art, that is to say a drive assembly of the aforesaid type provided with a passive safety system which is structurally and operationally effective and simple while allowing it to be easily assembled and mounted in the firearm.

According to the invention, the above said problem is solved by a drive assembly of a firearm basically comprising a hammer, a firing pin, a trigger and drive means acting on the aforesaid firing pin which are operated by the aforesaid trigger, wherein the aforesaid hammer, when pivoted to a frame of the firearm, is apt to be displaced at least between a first rest position and a second full-cock position, and wherein the aforesaid hammer comprises a main body having at least a first tooth, or full-cocking tooth, a first seat engaged by the aforesaid firing pin and a second seat engaged by the aforesaid drive means that intercepts the aforesaid first seat, and wherein the aforesaid firing pin and the aforesaid drive means are movable in the respective seats between at least a first rest portion, in which they are distal one from another, and a second firing position, respectively, in which they are proximal one to another, and wherein the aforesaid trigger comprises a first portion to be driven by a firearm user that, when the trigger is pivoted to the aforesaid firearm frame, is movable between at least a first rest position and a second firing position, respectively, and wherein the aforesaid trigger still comprises a second portion apt to interact with, i.e. to engage/disengage, the aforesaid first tooth for locking or unlatching the aforesaid hammer, and a third portion apt to interact with the aforesaid drive means, in particular apt to counter the aforesaid drive means when the aforesaid first portion of the trigger is in the aforesaid second firing position and the aforesaid first tooth is disengaged, i.e. unlocked from the aforesaid second portion of the trigger, with displacement of the aforesaid firing pin from the aforesaid first rest or safe position to the aforesaid second firing position.

Preferably, to facilitate the loading and unloading of bullets in the aforesaid firearm, the aforesaid hammer comprises a second tooth, or half-cocking tooth, arranged above the aforesaid first tooth and apt to individually interact, i.e. alternately to the latter, with the aforesaid second portion of the trigger, therefore to be engaged/disengaged with/from the second portion of the trigger.

Preferably, the aforesaid drive means comprise a transfer bar slidable in the aforesaid second seat, and a spring for countering/returning the aforesaid transfer bar, which is more preferably a spring combined, on the outside, around the aforesaid transfer bar.

Preferably, the aforesaid drive means are provided with a tapered element to displace the aforesaid firing pin, which is preferably formed by a smoothed part in the portion of the back end of the aforesaid firing pin, and, more preferably, by a smoothed portion or slanted face at one end of the aforesaid transfer bar facing the aforesaid firing pin.

Preferably, the aforesaid drive means comprise a first stop element, advantageously for the aforesaid firing pin, more preferably a first pin engaging a recess obtained in the side surface of the aforesaid firing pin.

Preferably, the aforesaid drive means comprise a second stop element, advantageously for the aforesaid transfer bar, more preferably a second pin engaging a recess obtained in the side surface of the aforesaid transfer bar.

Preferably, the aforesaid third portion of the trigger has an arched shape and more preferably extends from the aforesaid first portion of the trigger and terminates with a free end.

Preferably, the aforesaid first, second and third trigger portions are integral with each other.

Preferably, the aforesaid trigger is made in one piece.

In practice the present invention provides a drive assembly for a firearm, such as a revolver, having an effective passive and automatic safety system which is particularly simple, both structurally and functionally.

Advantageously, the present drive assembly comprises a retractable firing pin being hidden in the firearm frame when in rest or safe position, thereby preventing any accidental struck caused, for example, by impacts and therefore preventing the cartridges from being undesirably primed.

Moreover, advantageously, the user drives forward the firing pin by pressing the first portion of the trigger and then, thanks to the third portion of the same trigger which is substantially an appendage able to counter, by rotating, the drive means and, in particular the transfer bar of the drive means themselves, by forcing it into its seat to slide towards the upper end of the hammer, near the slider.

In this way, in the final stage of the hammer rotation, the transfer bar in its turn pushes the firing pin outward the respective seat, i.e. in the firing position thereby allowing the primer to be stricken.

Then, by releasing the trigger, the spring returns the transfer bar in its rest position thus releasing the firing pin.

According to the above, the aforesaid movements of the hammer, the trigger, the drive means and the firing pin from their first positions to the respective second positions, have to be intended as reversible.

Still according to the above, the present invention also provides a firearm, such as a revolver, comprising a drive assembly or device of the aforesaid type.

BRIEF DESCRIPTION OF THE DRAWINGS

Further characteristics and advantages of the invention will be more evident from a review of the following specification of a preferred, but not exclusive, embodiment, shown for illustration purposes only and without limitation, with the aid of the attached drawings, in which:

FIG. 1 schematically shows a partial longitudinal section of a drive assembly of a firearm, such as a revolver, according to the present invention, in a first configuration, called rest configuration, having the passive safety on;

FIG. 2 shows the drive assembly of FIG. 1 in a second configuration, called half-cock configuration, having the safety on;

DETAILED DESCRIPTION OF THE PREFERRED EMBODIMENTS

Figure 1:
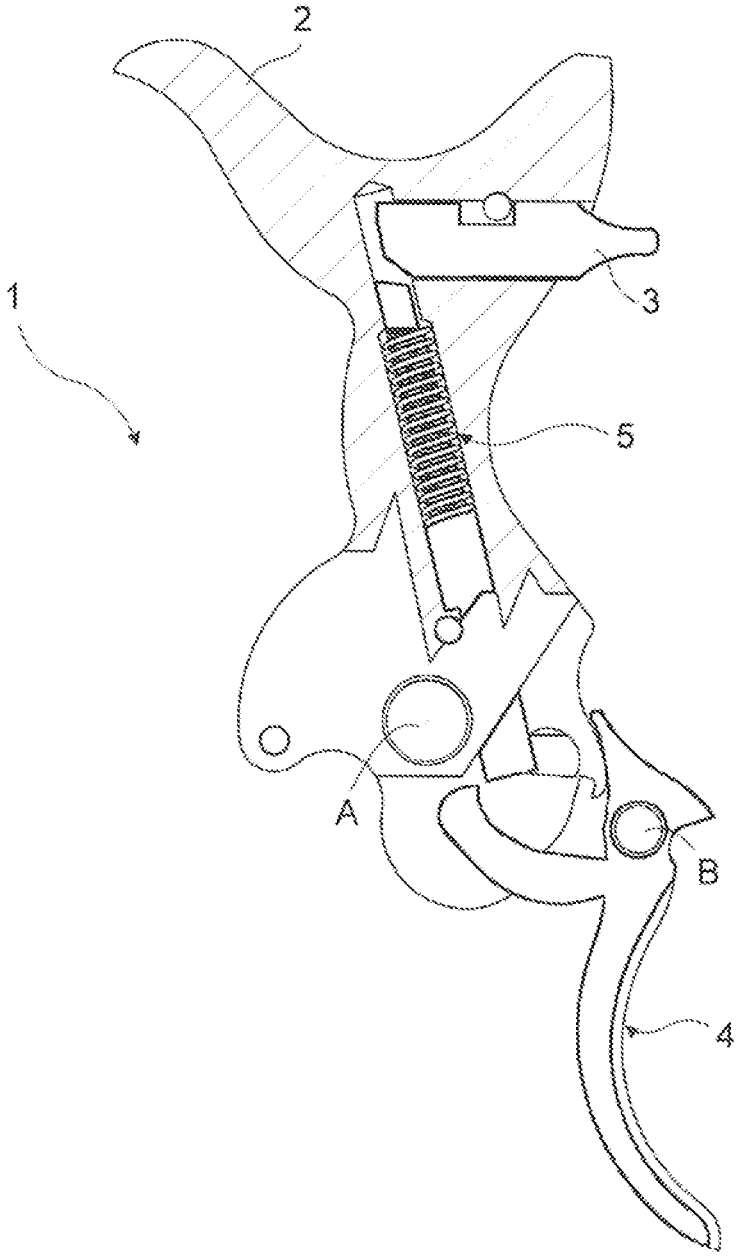

Referring to the aforesaid figures, a drive assembly of a firearm according to the present invention is collectively referred to with the numeral 1.

The drive assembly 1 basically comprises a hammer 2, a firing pin 3, a trigger 4 and drive means 5 operated by the trigger 4 for driving the firing pin 3.

The drive assembly 1 is conventionally combined with a revolver frame 6 and, in particular, is combined so that the hammer 2 is able to rotate around a respective rotation axis A and the trigger 4 is able to rotate around a respective rotation axis B parallel to A, advantageously driven by the firearm user thanks to a first portion 7 thereof, protruding from the revolver frame 6, as will become apparent hereinafter.

In detail, the hammer 2 comprises a main body having a profile with a first tooth 8 also called full-cocking tooth, and a second tooth 9 also called half-cocking tooth, wherein the second tooth is arranged above the first tooth and wherein either the first tooth 8 or the second tooth 9 are apt to individually interact with the trigger 4 and, in particular, are apt to be engaged/disengaged by a second portion 10 of the trigger 4, which is advantageously beak-shaped and is basically formed by an extension of the first portion 7 of the trigger beyond the rotation axis B.

In particular, the second tooth 9 is more prominent than the first tooth 8, by being substantially hook-shaped to be fitted to the second beak-shaped portion 10 of the trigger 4 and to lock the hammer 2 in a so-called half-cock position, whereas the first tooth 8 substantially is a step which causes the hammer 2 to lean against the same second portion 10 of the trigger 4 in a so-called full-cock position that can be released by operating the trigger.

When none of the first and second teeth is engaged by the trigger 4, the hammer 2, the firing pin 3, the trigger 4 and especially the first portion 7 of the latter, are in a rest position, wherein the trigger 4 leans against a side of the hammer 2 while the firing pin 3 is inside the revolver frame 6.

When the so-called fire stage, providing a fire start and a fire end as better understood hereinafter, is at the end, i.e. the shot took place, the configuration is the same as previously illustrated.

Furthermore, the hammer 2 is provided with a first seat 11 housing the firing pin 3 and a second seat 12 intercepting the first seat 11 and housing the drive means 5.

In the respective seats the drive means 5 and the firing pin 2 are movable between a first so-called rest position, in which they are distal from one another, and a second so-called firing position, in which they are proximal, particularly in contact, with one another.

When the firing pin is in a position distal from the drive means it is also in a safe position, basically inside the hammer or anyway retracted in its seat, whereas in the position in which the firing pin is proximal to the drive means, it is in a firing position basically protruding from the hammer or being anyway forward in its seat.

According to the invention, the trigger 4 comprises a third position 13 apt to interact with the drive means 5 and, in particular, apt to counter the drive means 5 when the first portion 7 of the trigger is in the firing position, the first tooth 8 of the hammer is disengaged, i.e. unlocked, from the second portion 10 of the trigger, with displacement of the firing pin 3 from the first rest or safe position to the second firing position.

In detail, the drive means 5 substantially comprise a transfer bar 14 slidable in the respective second seat 12 and a spring 15, for countering/returning the transfer bar 14 being advantageously combined, on the outside, around the transfer bar.

Furthermore, the drive means 5 are provided with a tapered element for the firing pin 3 to be displaced by the transfer bar 14, advantageously formed by a smoothed part 16 in the portion of the back end of the firing pin 3 and by a smoothed portion or slanted face 17 at one end of the transfer bar 14 facing the firing pin 3.

Moreover, the aforesaid drive means 5 comprise a first stop element 18 for adjusting the travel of the firing pin 3 in the first seat 11 of the hammer 2, and a second stop element 19 for adjusting the travel of the transfer bar 14 in the second seat 12 of the hammer 2.

In particular, according to the examples in figures, the first stop element 18 is formed by a first pin engaging a recess 20 obtained in the side surface of the firing pin 3, whereas the second stop element 19 is formed by a second pin engaging a recess 21 obtained in the side surface of the transfer bar 14.

Still according to the examples in figures, the third portion 13 of the trigger 4 has an arched shape extending from the first portion 7 of the trigger, below the rotation axis B of the trigger itself, and terminates with a free end.

According to the invention, the first, the second and the third portions of the trigger 4 are rotationally integral with each other, the trigger 4 being made advantageously in one piece.

Practically, referring to the example of FIG. 1 and considering the operation of the drive assembly in detail, it can be seen that, when in rest position, the hammer completely leans against the firearm body, i.e. on the revolver frame.

In the above considered position, also the firing pin is in the rest position, that is, in a back safe position such that it is not long enough to reach and strike the primer of a bullet positioned in a dedicated chamber in the revolver frame (passive safety).

In the same position as above, also the trigger is in the rest position and it leans, particularly by its second beak-shaped portion, against the hammer profile.

Figure 2:
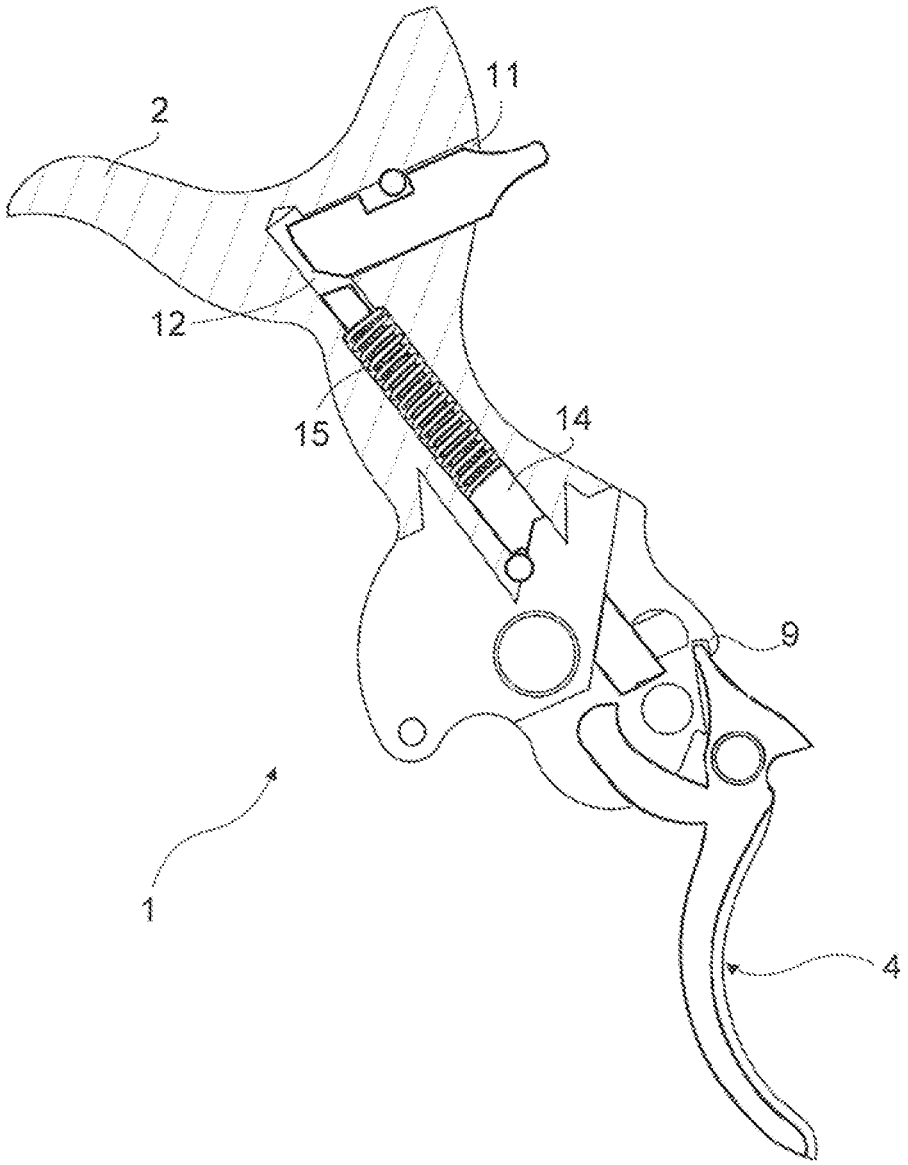

Referring to the example in FIG. 2, it can be seen that by rotating the hammer (counterclockwise), the position indicated as "half-cock" is reached, where the trigger (the second portion thereof) is held in an indentation (second tooth) on the hammer and its appendage (third portion of the trigger) is not able to interfere with the transfer bar of the drive means, so as it remains in a rest position.

In the half-cock position, useful for inserting and removing the bullets in the revolver, the trigger is locked and movements are not allowed.

Figure 3:
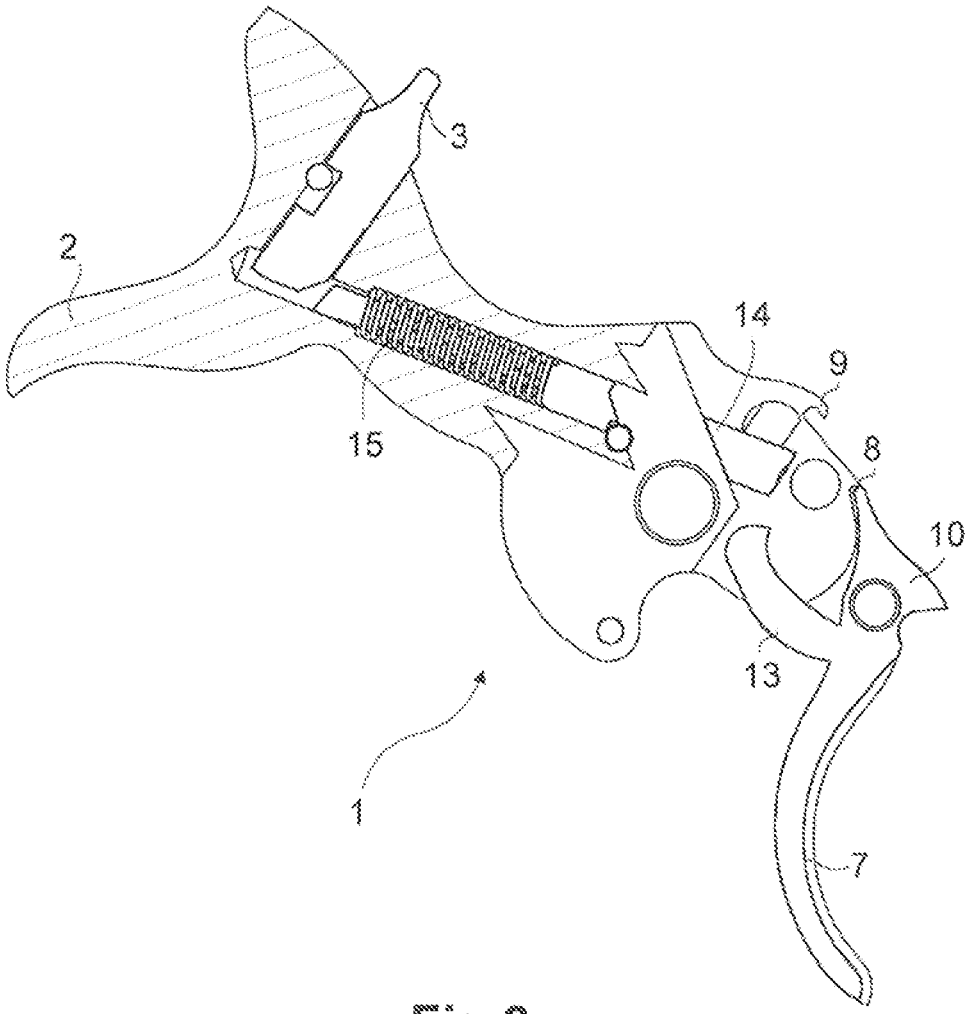
FIG. 3 shows the drive assembly of FIG. 1 in a further configuration, called full-cock configuration.

By keeping the rotation of the hammer (again counterclockwise) a position is reached called "full-cock position", shown in the example of FIG. 3.

In the full-cock position, the hammer, in particular the first tooth thereof, leans against the trigger while the trigger appendage (third portion of the trigger) is still free, i.e. it does not interfere with any other component of the drive assembly.

Figure 4:
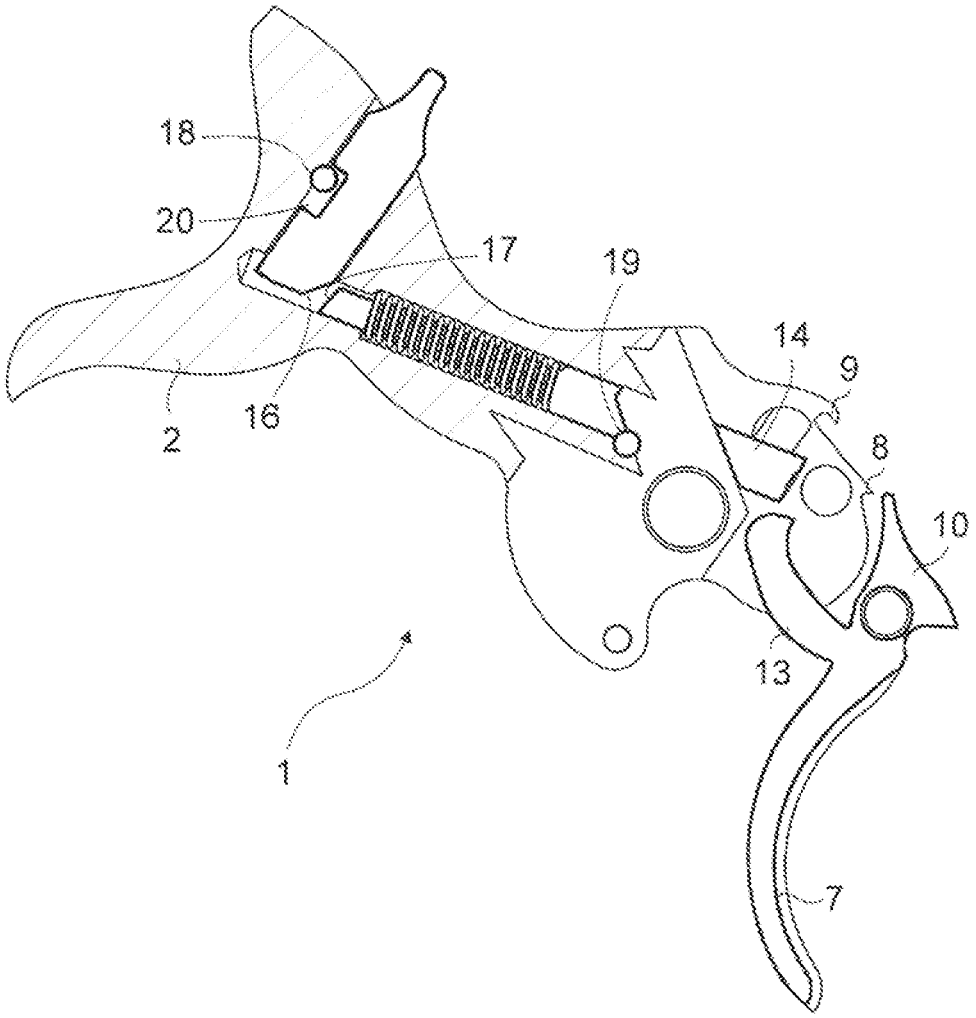
FIG. 4 shows the drive assembly of FIG. 1 in a further configuration called fire-start configuration.

By pulling the trigger on, as shown in the example of FIG. 4, the mechanism leading to fire is started, in particular the hammer is released (starting its clockwise rotation), and the trigger appendage, thereby its third portion, rotates (clockwise) until it intercepts the transfer bar of the drive means.

During the aforesaid hammer movement, that is during the fire stage, the revolver user always pulls the trigger on, i.e. presses it, while the hammer rotates around its own axis until the transfer bar intercepts the trigger appendage (the third portion of the trigger) which thus is forced to slide in its seat towards the firing pin by virtue of the arched shape of the appendage itself.

In particular, the transfer bar slides towards the firing pin thereby compressing the spring until in contact with the firing pin, in the last stage of the hammer rotation.

Figure 5:
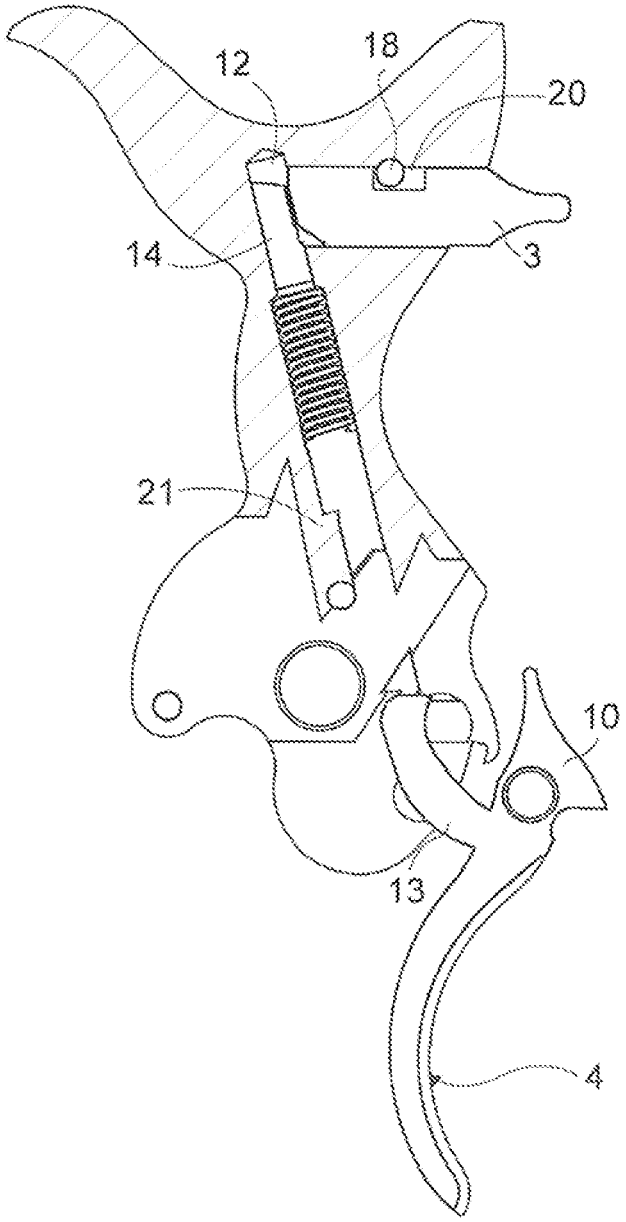
FIG. 5 shows the drive assembly of FIG. 1 in a further configuration, called fire-end configuration.
Figure 6:
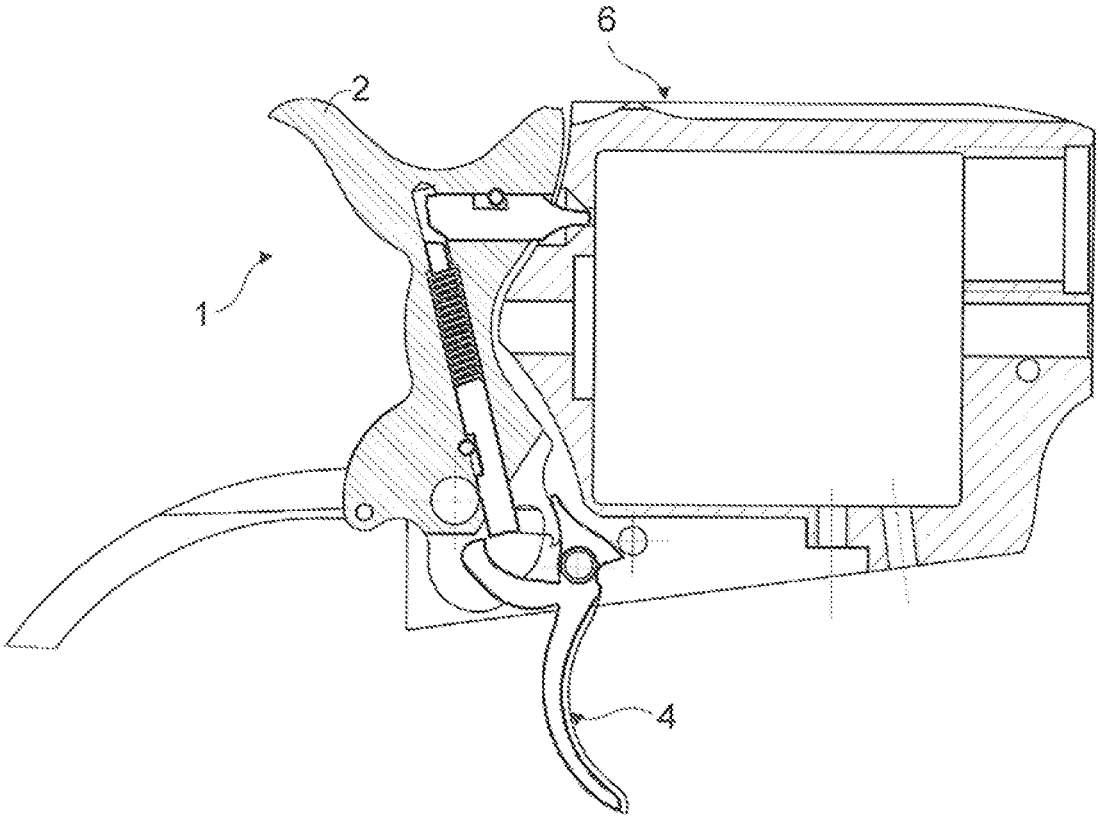
FIG. 6 shows a longitudinal section of the drive assembly of FIG. 1 in the rest configuration, when combined with a revolver frame.

So, in the actual fire time, the firing pin is pushed outward its seat by the transfer bar which "transfers" to it the kinetic energy of the hammer thereby allowing the primer to be correctly struck, as shown in the example of FIG. 5.

After firing, by releasing the trigger, its appendage (third portion) rotates counterclockwise and substantially moves downward thereby releasing the transfer bar which therefore, being facilitated by the return spring, slides back in its seat to the rest position.

Consequently, even the firing pin, no longer in contact with the transfer bar, can return to the back safe position shown in FIG. 1.

It is possible to summarize the advantages of the present invention, already highlighted in the description above, noting that it provides a drive assembly of a firearm, such as a revolver, provided with a passive and automatic safety system, particularly simple both structurally and functionally thanks to the few components, thereby being easy to be realized and to be mounted in the firearm, as well as particularly inexpensive, and meeting the applicable safety standards, on the whole.

In order to meet incidental and specific requirements, several variations and modifications could be made by a field technician to the illustrated and described embodiments of present invention, provided that all are included in the scope of protection of the invention as defined by the following claims.

What is claimed is:

1. Drive assembly (1) of a firearm comprising:

a hammer (2), a firing pin (3), a trigger (4) and a drive mechanism (5) configured to drive said firing pin, said drive mechanism (5) being operable by said trigger, wherein said hammer (2), when pivoted to a frame (6) of the firearm, is configured to be displaced at least between a first rest position and a second full-cock position, and wherein said hammer (2) comprises a main body having at least a first tooth (8), a first seat (11) engaged by said firing pin (3) and a second seat (12) engaged by said drive mechanism (5) that intercepts said first seat (11), wherein said firing pin (3) and said drive mechanism (5) are movable in the respective seats between at least a first rest position, in which they are distal one from another, and a second firing position, respectively, in which they are proximal one to another, wherein said trigger (4) comprises a first portion (7) to be driven by a firearm user that, when said trigger is pivoted to the firearm frame, is movable between at least a first rest position and a second firing position, respectively, and wherein said trigger (4) comprises a second portion (10) configured to engage and disengage said first tooth (8) and a third portion (13) which encounters said drive mechanism (5) when said first portion (7) of the trigger is in said second position and said first tooth (8) is disengaged from said second portion (10) of the trigger, said firing pin (3) is displaced from said first rest position to said second firing position; and wherein said drive mechanism comprise a second stop element (19) for adjusting travel of a transfer bar (14) in said second seat (12).

2. The drive assembly according to claim 1, wherein said hammer (2) comprises a second tooth (9) arranged above said first tooth (8) and configured to be engaged or disengaged by said second portion (10) of said trigger (4).

3. The drive assembly according to claim 1, wherein said drive mechanism (5) comprises said transfer bar (14) movable in said second seat (12), and a spring (15) for countering or returning said transfer bar.

4. The drive assembly according to claim 3, wherein said spring (15) is combined, on the outside, around said transfer bar (14).

5. The drive assembly according to claim 1, wherein said firing pin is provided with a smoothed part (16) in a rear portion thereof.

6. The drive assembly according to claim 3, wherein said transfer bar (14) is provided with a smoothed portion or slanted face (17) at one end facing said firing pin (3).

7. The drive assembly according to claim 1, wherein said drive mechanism comprise a first stop element (18) for adjusting travel of said firing pin (3) in said first seat (11).

8. The drive assembly according to claim 1, wherein said third portion (13) of said trigger (4) has an arched shape extending from said first portion (7) of the trigger and terminates with a free end.

9. The drive assembly according to claim 1 wherein said trigger is made in one piece.

10. A firearm, comprising a drive assembly of the firearm according to claim 1.

* * * * *